US006152154A

United States Patent [19]

Elgharini

[11] Patent Number: 6,152,154

[45] Date of Patent: Nov. 28, 2000

[54] CONVEYOR SYSTEM FOR DISHWASHING

[75] Inventor: Ali Elgharini, Mississauga, Canada

[73] Assignee: Conwash Systems Ltd., Mississauga, Canada

[21] Appl. No.: 09/221,054

[22] Filed: Dec. 28, 1998

[30] Foreign Application Priority Data

Sep. 9, 1998 [CA] Canada ..... 2246921

[51] Int. Cl.[7] ..... A47L 15/24

[52] U.S. Cl. ..... 134/71; 134/83; 134/165; 198/377.02; 198/476.1; 198/477.1; 198/680

[58] Field of Search ..... 134/71, 72, 73, 134/83, 165; 198/377.02, 474.1, 476.1, 477.1, 680, 802

[56] References Cited

U.S. PATENT DOCUMENTS

| | | | |
|---|---|---|---|
| 524,510 | 8/1894 | Sanderson et al. | 134/83 |
| 886,097 | 4/1908 | Vaudreuil | 134/71 |
| 2,061,165 | 11/1936 | Miller | 198/680 |
| 2,358,507 | 9/1944 | Haberstump | 134/72 |
| 2,570,746 | 10/1951 | Bablik . | |
| 2,921,008 | 1/1960 | Hauck et al. | 134/83 X |
| 2,988,012 | 6/1961 | Markley . | |
| 3,006,452 | 10/1961 | Hill . | |
| 3,171,536 | 3/1965 | Johnson | 198/680 X |
| 3,777,872 | 12/1973 | Rikman et al. | 198/476.1 X |
| 4,062,440 | 12/1977 | Barry et al. | 198/477.1 X |
| 4,274,783 | 6/1981 | Eineichner et al. . | |
| 4,475,462 | 10/1984 | Tsumaki et al. . | |
| 5,307,921 | 5/1994 | Richardson . | |
| 5,653,324 | 8/1997 | Toeniskoetter . | |

FOREIGN PATENT DOCUMENTS

| | | | |
|---|---|---|---|
| 207759 | 2/1960 | Austria | 198/680 |

*Primary Examiner*—Philip R. Coe
*Attorney, Agent, or Firm*—Gifford, Krass, Groh, Sprinkle, Anderson & Citkowski, P.C.

[57] ABSTRACT

A monorail conveyor system used to transport dishes to and from a dishwashing unit including a monorail mountable to a ceiling or a support frame, the monorail being of substantial length such as to form a loop traversing the entire dishwashing system. The monorail is hollow and mounted therein is a continuous chain supported by a plurality of wheels. A number of dish rack holders are each suspended from the chain by vertically extending bars which are pivotably attached to the chain conveyor so that the holder can tilt at a loading or unloading station. Guide wheels and an elongate horizontal track are provided to either support the holders in a horizontal position or permit them to tilt at the aforementioned stations. The guide wheels are preferably mounted at the bottom of the bars below the holders. The track is fixedly mounted and provides a horizontal force to each guide wheel.

22 Claims, 7 Drawing Sheets

CONVEYOR SYSTEM FOR DISHWASHING

FIELD OF THE INVENTION

This invention relates to dishwashing and conveying systems and, in particular a dishwashing system suitable for commercial and institutional use.

BACKGROUND OF THE INVENTION

The concept of a monorail in a conveying system is known art A monorail provides an effective transportation system for conveying objects especially when the objects are to be conveyed through a known path of determinant length. Monorail systems are known in various applications including auto part transport, galvanizing, material transport along a work line, and parcel sorting just to name a few.

In one particular commercially available institutional dishwashing system, dirty dishes intended to be washed by the dishwasher must be manually loaded by a worker. This particular dishwashing system includes a roller based conveyor system for moving dirty dishes to the dishwasher, normally by loading the dirty dishes onto plastic wash racks suitable for the conveyor. The dirty dishes are loaded into the wash racks by a worker using a pivoting loading device. After the plastic wash racks are loaded, these are fed directly into the dishwasher by means of the conveyor.

In another known institutional dishwashing system, a nearly complete loop conveys dishes to a dishwasher by means of a series of rollers. These rollers are stepped in such a way so that gravity ensures that the dishes reach the dishwasher. This dishwashing system is further equipped with controls to stop the dishes from being conveyed in the case of an emergency.

It is an object of the present invention to provide a monorail system for carrying objects, such as dishes, between loading and unloading stations which is relatively inexpensive to build and maintain and which causes a tray used to hold the objects to tilt from the horizontal at the loading or unloading station to make it easier to load or unload the objects.

It is a further object of the present invention to provide an improved dishwashing system that includes a dishwasher unit and a monorail-type conveyor extending through this unit and capable of moving dishes through the unit.

SUMMARY OF THE INVENTION

Accordingly to one aspect, a dishwashing system constructed in accordance with the invention comprises a dishwasher unit with a passageway extending therethrough, a monorail-type conveyor forming a substantially horizontal loop, and a number of holders mounted along said conveyor for holding dishes and other utensils to be cleaned by said dishwasher unit, wherein during use of the system, the holders can traverse the entire loop and are movable through said passageway by said conveyor in order to clean said dishes and other utensils.

According to another aspect of the invention, there is provided a monorail system for carrying objects between loading and unloading stations, said system comprising a monorail forming a loop, a continuous flexible conveying device movable along said monorail, a holder for carrying objects, means for attaching said holder to said conveying device, a guide wheel mounted to the holder in order to maintain the holder substantially horizontal between said loading and unloading stations and a track along which said guide wheel runs between the loading and unloading stations, the track in use being mounted in a fixed position and being capable of providing a substantially horizontal force to the guide wheel between said loading and unloading stations in order to maintain the holder substantially horizontal, wherein at the loading and unloading stations, the holder is caused to tilt from the horizontal due to the position of said track relative to said monorail and engagement of said guide wheel with said track.

According to a further aspect of the invention, a dishwashing system comprises a monorail forming a loop, a continuous, flexible conveying device movable along said monorail, a holder for carrying objects, means for attaching the holder to the conveying device, a wheel mounted to the holder in order to maintain the holder substantially horizontal between loading and unloading stations, a dishwasher unit through which the holder is movable by the conveying device, and a track along which the guide wheel runs between the loading and unloading stations. The track in use is mounted in a fixed position and is capable of providing substantially horizontal force to the guide wheel between the loading and unloading stations in order to maintain the holder substantially horizontal. At the loading and unloading stations, the holder is caused to tilt from the horizontal due to the position of the track relative to the monorail and engagement of the wheel with the track.

The present invention provides a monorail system which can extend the length of an institutional dishwashing system. In a preferred embodiment, the monorail is hollow and tubular with an open bottom. A conveying device such as a chain extends along the monorail and is supported in the monorail by means of rollers. Monorails of this general type are known per se in the object conveying art but have never been employed in a dishwashing system as far as the applicant is aware.

In particular, the device for conveying dirty dishes includes a normally horizontally level holder within which the dishes are placed. Loaded dish racks can also be placed in these holders. Rigidly attached, and extending perpendicularly and normally vertical to the holder is a support bar, and this bar has a swivel attached to a hook permitting the bar and the attached holder to pivot as they move along the path of the monorail. However, the amount of pivoting of the bar and attached holder, if any, is controlled and the holder is normally kept in a horizontal position when it is moving between dish loading and dish unloading positions.

The preferred dishwashing system described herein employs guide wheels to control the tilt of the holders. For the portion in the monorail system where the holders are not at a loading or unloading station, a track supports the guide wheels thereby supporting the conveyed holders in a horizontal position. However, at the loading or unloading station, the holders are caused to tilt from the horizontal due to the position of the track relative to the monorail and engagement of the wheels with the track.

In one preferred embodiment of the dishwashing system of the invention, the system includes a monorail-type conveying system, a washer and dryer for dishes, a loading station, and an unloading station, and a suitable control system. The movement of the conveying system is indexed in the dishwasher through each dishwashing stage. The stop time through this indexing process can be approximately fifteen seconds, but the timing can be adjusted. Also the speed and braking of the dishwashing system can be adjusted using a DC motor speed control.

The dishwashing system preferably forms a complete substantially horizontal loop from loading station, to dishwasher, to dryer to unloading station. Although the loop could take the shape of an elongate "O", the loop could also be in a wide variety of other shapes to accommodate the room space requirements, or to accommodate a desired placement of loading or unloading stations.

Further features and advantages will become apparent from the following detailed description of a preferred embodiment taken in conjunction with the accompanying drawings.

DETAILED DESCRIPTION OF PREFERRED EMBODIMENT

Figure 1:
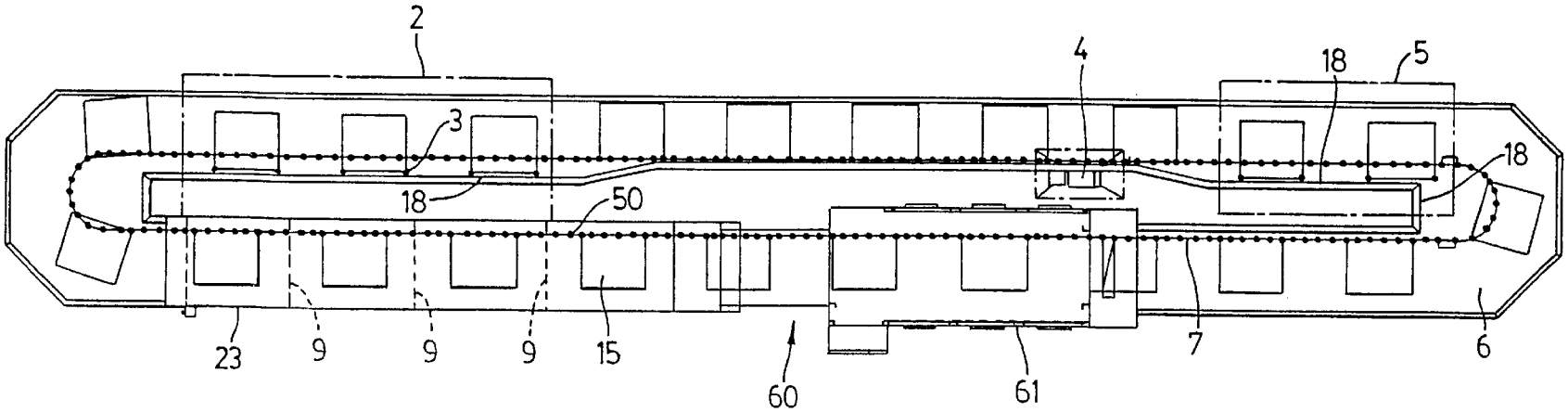
FIG. 1 is a plan view of a dishwashing system comprising a monorail loop and showing loading and unloading stations, a washer, and a dryer which form part of the system.

FIG. 1 illustrates a dishwashing system 60 capable of washing a large number of dirty dishes and eating utensils and then drying same. This system is suitable for commercial dishwashing purposes or an institutional setting where a large number of dishes and utensils must be washed and dried on a frequent basis. The system includes a monorail-type conveyor 7 that extends through a passageway formed in an elongate dishwasher unit 23 and also through a passageway formed in a dryer 61. A number of containers or rack holders 15 are mounted along the conveyor 7 and these are used to hold the dishes and other utensils to be cleaned by the dishwasher unit 23 as they pass through this unit. The dishes can be in a known type of dish rack detachably mounted in the holder 15.

The monorail-type conveyor 7 preferably forms a substantially horizontal loop such as the elongate loop illustrated in FIG. 1. Other loop configurations for the monorail-type conveyor are quite possible including configurations having the shape of a T with unloading occurring along the top of the T shape and the shape of the letter H with unloading occurring along the outside of one vertical leg of the H shape and loading occurring on the outside of the other vertical leg. The configuration will depend to some extent on the available room layout and other parameters well known in the commerical dishwashing art. The dishes are conveyed horizontally by the conveyor 7 between a loading station indicated at 2 in FIG. 1 and an unloading station indicated at 5. It will be appreciated that the movement of the conveyor is indexed and intermittent and this enables workers to have sufficient time to load and unload dishes at these stations and also permits the necessary cleaning process to occur in the dishwasher unit and the necessary time interval to elapse in the dryer 61.

The preferred dishwasher unit is divided into several substages schematically indicated in FIG. 1 by the dashed dividing lines at 9. These stages preferably include substages comprising pre-wash, wash, and rinse moving from the entrance end to the exit end. Also, in the preferred illustrated system a table 6 is provided below the path of the trays 15. The table primarily acts as a drip pan in order to maintain the room clean and dry. At the loading station 2, the table can be fitted with receptacles for holding waste.

Figure 2:
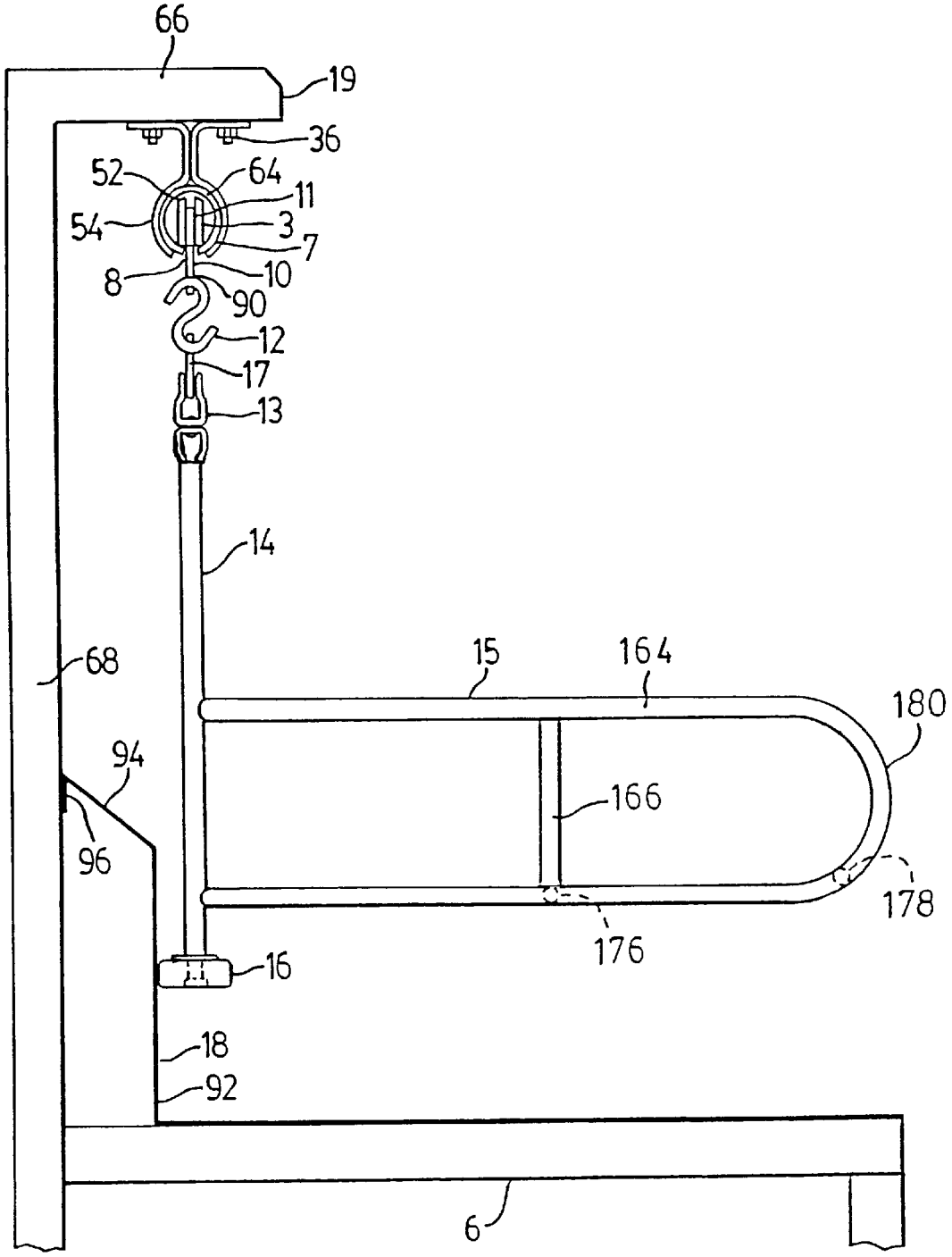
FIG. 2 is an elevational view of the conveying system at a location in the dishwashing system between the loading and unloading stations.
Figure 3:
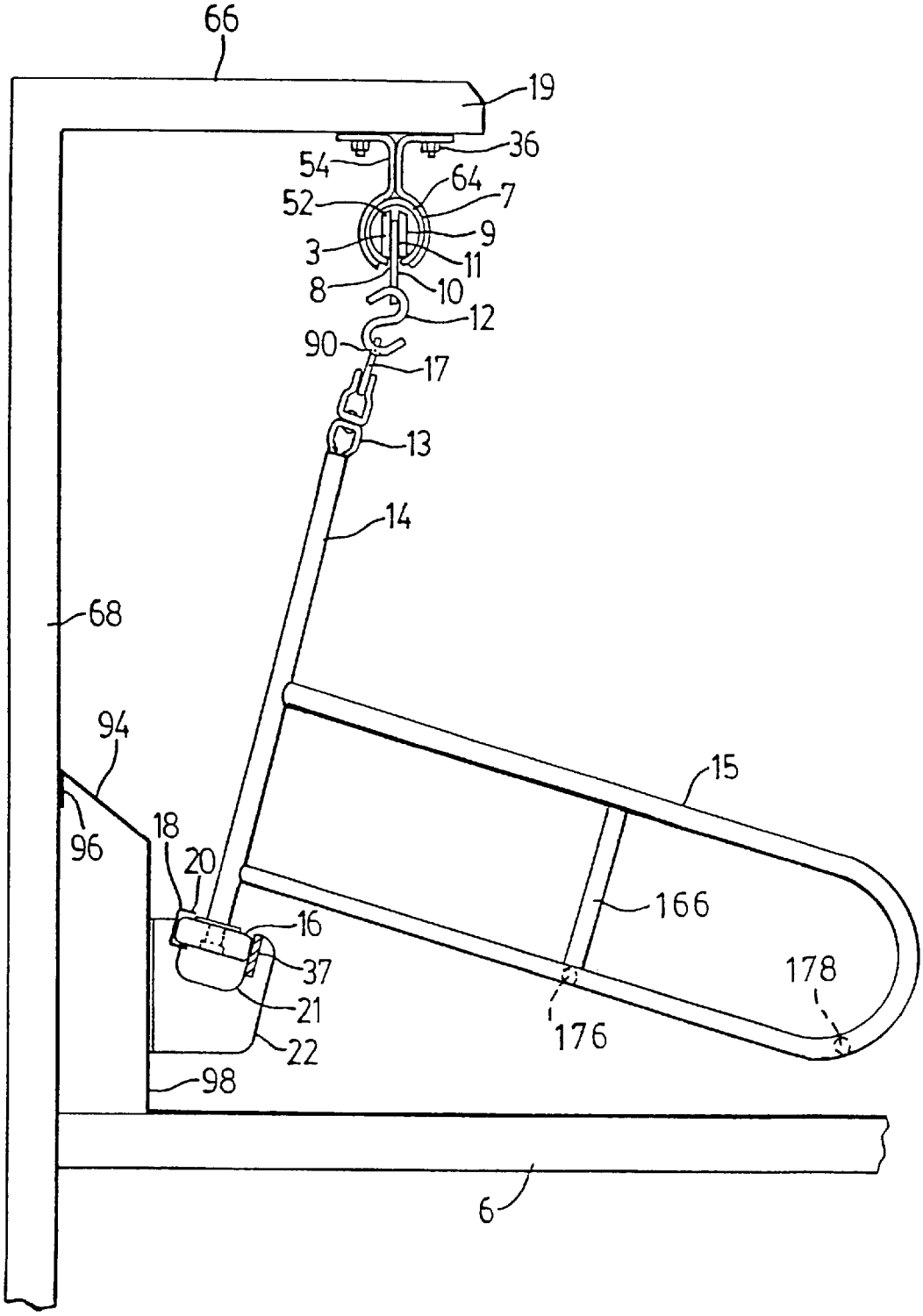
FIG. 3 is an elevational view of the conveying system at a loading or unloading station.

Turning now to FIGS. 2 and 3 of the drawings which illustrate the basic structure of the preferred monorail-type conveyor 7 and the containers 15 suspended therefrom, the conveyor includes a monorail 64 which, as indicated, forms a loop extending generally horizontally. The preferred monorail is generally tubular with an open bottom at 8. The monorail can be rigidly supported along its length by means of brackets 54 attached by bolts 36 to supporting frames 19. Along most of the length of the monorail the spaced-apart frames 19 can be generally L-shaped as illustrated extending upwardly from the table 6. Thus, each frame 19 includes a horizontally extending section 66 to which the brackets are connected and a vertical leg 68. At the loading or unloading station where the trays are tilted as shown in FIG. 3, the horizontal section 66 of the frame can be made longer to permit tilting to occur as explained further hereinafter.

Figure 5:
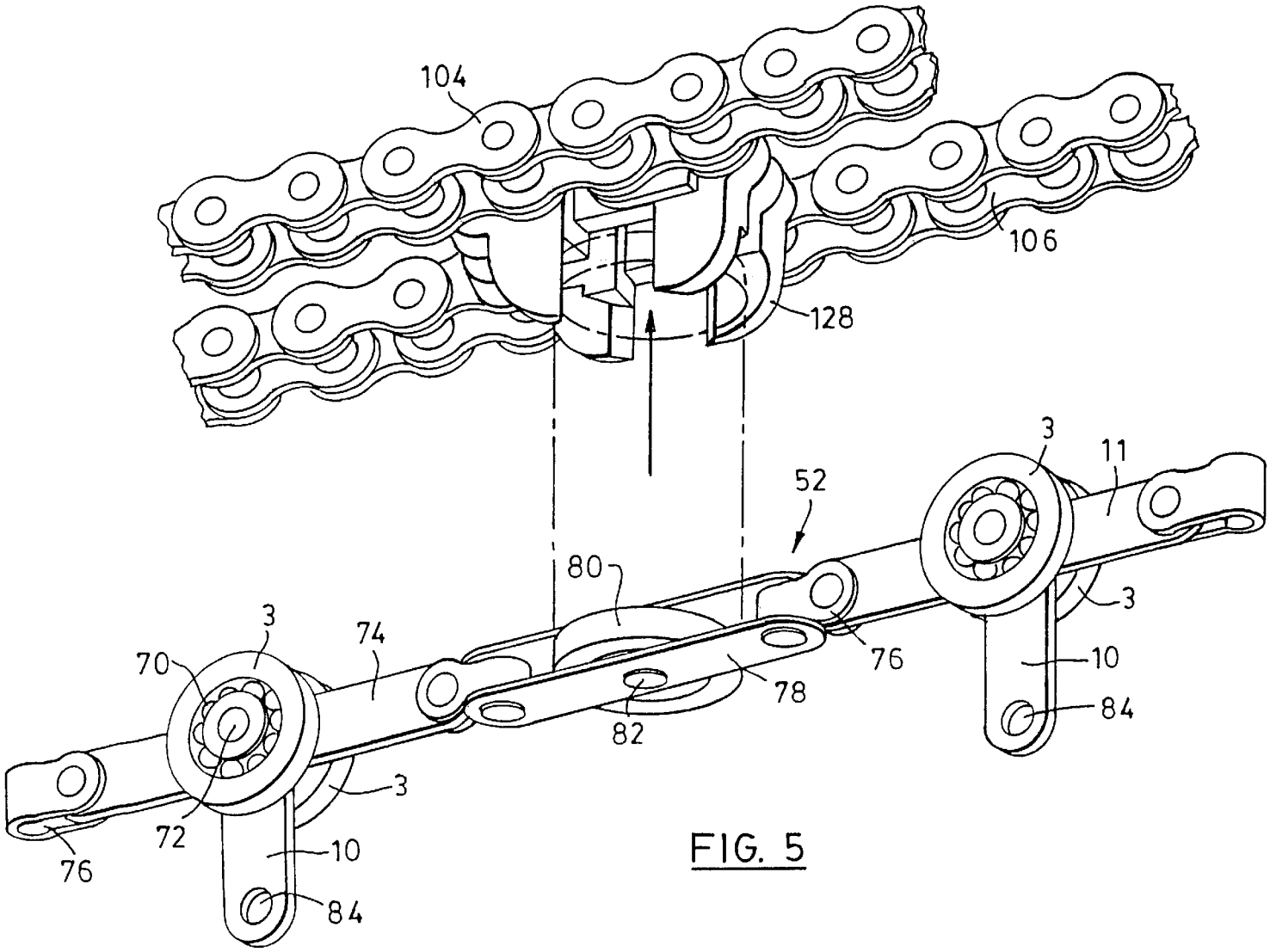
FIG. 5 is a perspective view taken from below showing the conveyor chain for the dishwashing system and also showing how the drive mechanism engages the conveyor chain.

A continuous flexible conveying device 52 is movable along the monorail 64 and in the illustrated preferred embodiment this conveying device comprises a continuous chain arranged within the monorail. The chain must be constructed with sufficient strength and durability to withstand the load carrying capacity for which the system is designed. Along its length, the chain is supported in a manner known per se by twin load carrying wheels 3 (see FIG. 5). Preferably the circumferential exterior of the wheels is rotatably mounted on bearings indicated at 70 and each pair of wheels is mounted on an axle 72 that extends through the center of adjacent chain-link 74. Each link 74 has a connecting loop 76 at each end. Two adjacent loops are connected together by two parallel, spaced apart links 78 between which is mounted a single guidance wheel 80. The wheel 80 is connected by means of a shaft 82 to these links. It will be appreciated that the wheels 3 support the weight of the conveyor chain and the objects and trays hanging therefrom while engaging the inside of the monorail 64. The guidance wheels 80 help to keep the conveyor chain properly positioned in the center of the monorail. This type of conveyor chain, the drive mechanism therefor and the illustrated monorail are per se known and are available (for example) from Bridgeveyor Overhead Systems Ltd. of Markham, Ontario, Canada. The conveyor chain in this system is preferably prestretched so that it will run smoothly through the monorail. Also shown in FIG. 5 are two of the flat metal chain extensions 10 which are used to connect the rack holders to the chain. These extensions can be rigidly connected to or integral with the corresponding chain links 74. A connecting hole 84 is provided at the bottom end of the extension.

Figure 8:
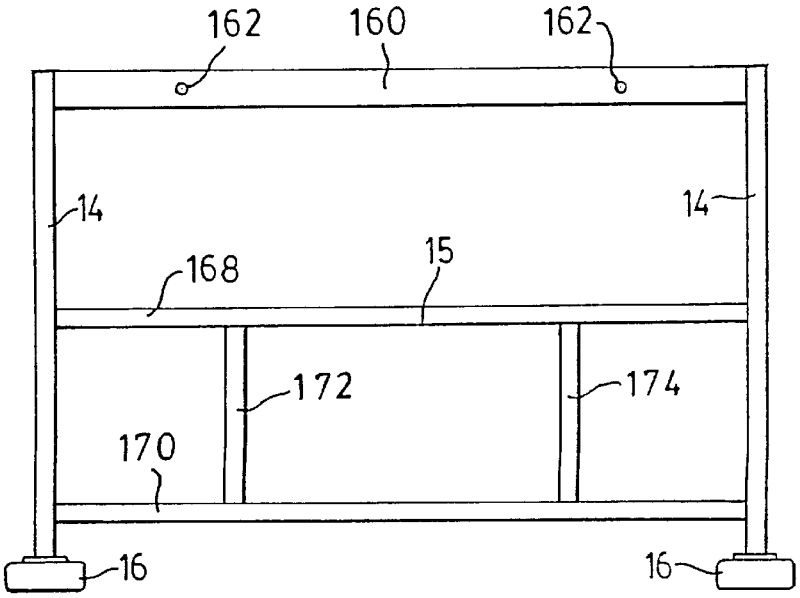
FIG. 8 is a side view of a single tray for holding dishes together with two vertically extending hanger bars used to suspend the tray.

Returning to FIGS. 2 and 3 of the drawings, it will be seen that a vertically extending hanger bar 14 is rigidly attached to one side of the rack or object holder 15, preferably at one corner of the tray. In fact, as illustrated in FIG. 8, there are preferably two hanger bars connected to the same side of the holder adjacent opposite ends thereof. The top ends of the hanger bars are connected to each other by a flat horizontal bar 160 having two attachment holes 162. The bar 160 can be a flat stainless steel bar that measures 1¼"×¼" in a preferred embodiment. The bar 160 is connected to two of the extensions 10 by means of two swivel mechanisms 13 and S-shaped hooks 12. The top end of the hook extends through the hole 84 in the extension. The top of the swivel can be provided with a flat metal connector 17 having a hole at 90 through which the bottom end of the hook extends. The hanger bars 14 are preferably flat stainless steel bars which in one embodiment are about 14 inches long, and the aforementioned components connecting each bar to the conveyor chain can also be made of stainless steel to prevent rusting. It will be understood that the hanger bars 14, the swivel mechanisms 13, the S-shaped hooks 12, and the chain extensions 10 form a hanger bar mechanism for attaching a respective holder 15 to the conveying device. The container or holder 15 is preferably made of stainless steel bars and in one embodiment measures approximately two feet by two feet in the horizontal directions. The preferred holder 15 is made as an open framework using grids of flat or round bars in order to permit water to flow freely therefrom and to permit water to be sprayed through the walls and bottom of the holder.

In the preferred illustrated holder 15, there are two long, round side bars 164 bent in the shape of a U and each connected to a respective one of the hanger bars 14. The top and bottom legs of each side bar are connected at their centres by a vertical connecting bar 166. Straight, upper and lower connecting bars 168, 170 are used to join the two hanger bars together. Also, two further vertical connecting bars 172, 174 (see FIG. 8) extend between and connect the horizontal connecting bars 168, 170. Two straight bottom bars located at 176 and 178 extend horizontally between the side bars 164. The ends of these bars 176, 178 can be seen in dashed outline in FIGS. 2 and 3. This preferred holder 15 has an open top and its front end at 180 is also substantially open to permit easy insertion of a plastic dish rack (not shown). Of course, depending on the purpose of the monorail conveyor, the holders 15 can have substantially or completely enclosed vertical sides and bottom, if desired.

A plastic guide or stabilizing wheel 16 is rotatably mounted at the bottom end of each hanger bar 14. These wheels run along a horizontally extending, elongate track 18. The guide wheels 16 are mounted to each tray or container in order to maintain it substantially horizontal (as shown in FIG. 2) between the loading and unloading stations 2 and 5. The track 18 in use is mounted in a fixed position and is capable of providing a substantially horizontal force to each guide wheel 16 between the loading and unloading stations in order to maintain the trays 15 substantially horizontal. However, as shown in FIG. 3, at the loading and unloading stations, the tray or container 15 is caused to tilt from the horizontal due to the position of the track 18 relative to the monorail and engagement of the guide wheels 16 with the track. To permit the tilting to occur, the hanger bars 14 are pivotable about a horizontal axis (generally in the vicinity of the S-shaped hook) located at its upper end and extending parallel to the adjacent monorail. Each tray or container 15 preferably extends perpendicularly and normally horizontally (as shown in FIG. 2) from its respective hanger bars 14.

Between unloading and loading stations where the open-top holders 15 are maintained in a horizontal position and outside of the dishwasher and the dryer, the elongate track 18 can be constructed in the simple manner illustrated in FIG. 2, and made of sheet metal bent to the profile shown in FIG. 2. An upwardly extending wall 92 forms the track surface engaging the wheel 16. The upper end of the wall can be supported by a sloping section 94 having a downwardly extending flange 96 at the top. The flange 96 can be rigidly attached, for example by welding, to each of the frames 19. The bottom end of the wall can be attached to the top of the table 6. Preferably the track is constructed from stainless steel and the sheet metal should be sufficiently rigid and sufficiently supported to avoid bending of the wall 92 as the wheels run along the track.

At the dish unloading or loading station shown in FIG. 3, the trays 15 are tilted to make it easier for a worker to load or unload the dishes. At these locations the track 18 is supported by means of a sheet metal wall 98 that can be constructed and supported in a manner similar to the track wall 92. However, at these locations the track 18 is mounted on the wall 98 and is not formed by the wall 98 itself. The track 18 is rigidly mounted on the wall by means of a number of spaced apart brackets 22, each of which is generally U-shaped so that it forms an open topped wheel opening 21. The brackets 22 can be formed from 12 gauge stainless steel and spaced from each other a distance ranging between 24 inches and 36 inches. On one side of this wheel opening is a sharply inclined track member 37 while, on the opposite side of the opening, there is a channel-shaped track member 20. Thus, the two track members 20 and 37 are arranged on opposite sides of the guide wheel 16 and are spaced from each other a distance about equal to or slightly more than the diameter of the wheels. The use of the two track members as shown helps to keep the containers 15 stable in the tilted position. Thus, when a conveyor stops, the container is sufficiently supported to permit loading or unloading of dishes. It will be seen from FIG. 3 that the tilting of the container is the combined result of the horizontal position of the track 18 relative to the monorail 64 located above it and the engagement of the wheels 16 with the track. In other words, because the track is displaced in the horizontal direction relative to the monorail, the hanger bars are required to pivot away from the vertical position of FIG. 2 to the sharply inclined position shown in FIG. 3 causing a substantial tilt of the attached container. Note that it is also possible to construct the track member at the unloading or loading station without the second track member 37 because the weight of the container and any dishes loaded therein will cause the hanger bars to pivot to the position shown in FIG. 3 in any event, keeping the trays engaged with the track member 20. However, the addition of the second track member 37 helps to keep the container or tray motionless for a loading or unloading operation.

Figure 4:
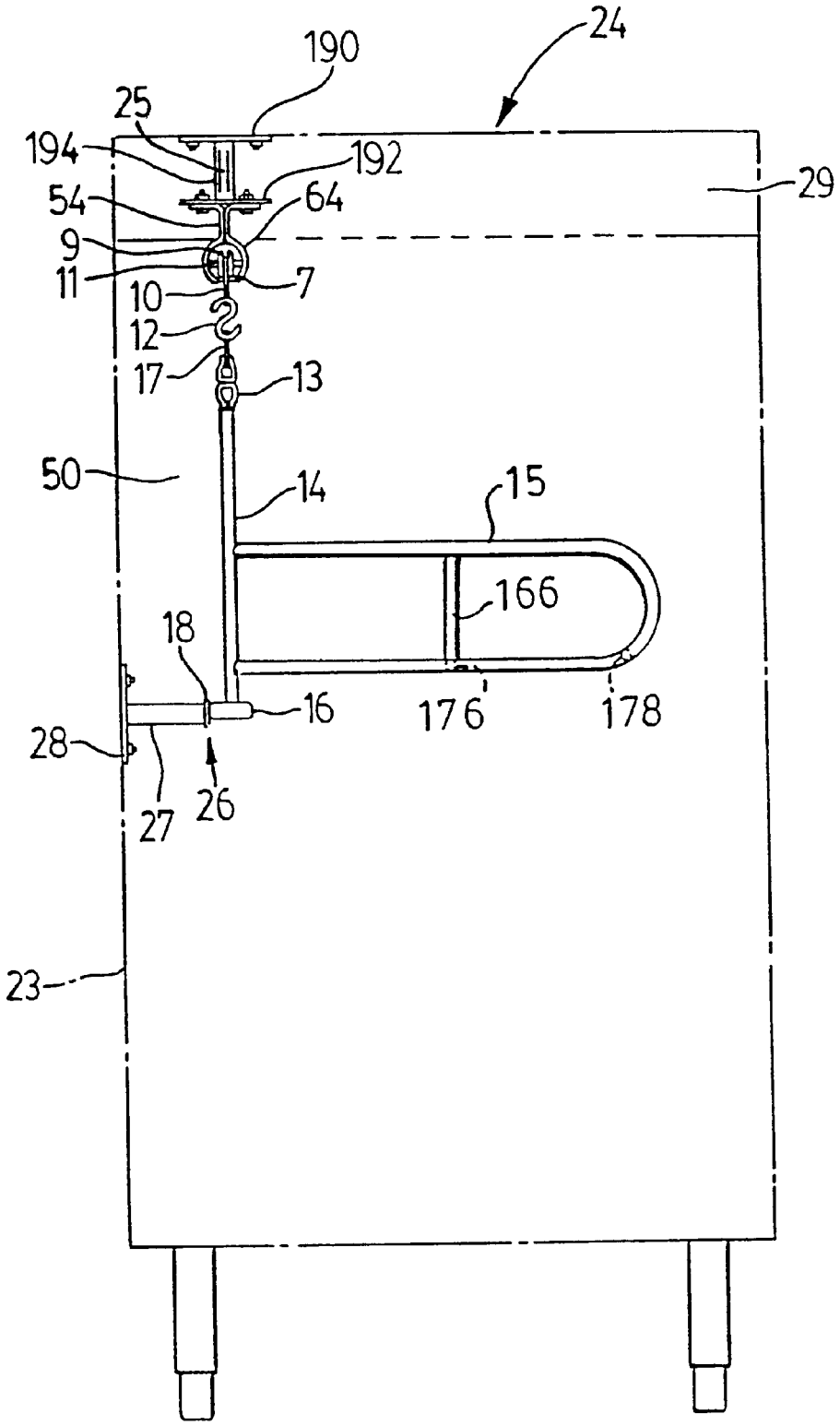
FIG. 4 is an elevational view of the conveying system where it extends through a dishwasher or dryer.

Turning to FIG. 4 of the drawings, there is shown an arrangement for extending the conveying device 52 through a dishwasher indicated at 23 in dot-dash lines. A similar conveying arrangement can also be used in the dryer 61. Stainless steel vertical connectors 25 can be bolted to the top 24 of the machine near one side thereof. Each connector 25 includes two spaced-apart plates 190, 192, that can be made of 12 gauge stainless steel for example. The two plates are rigidly connected together by a 1" round stainless steel tube 194. In one version of the dishwasher, the connectors are spaced apart a distance ranging between 24 inches and 36 inches. The monorail 64 is connected by means of the aforementioned brackets 54 to the bottom end of the connectors 25 by means of bolts. The elongate track 18 continues through the washing machine 23 and can take the form of a relatively narrow, stainless steel bar or strip 26, the ends of which meet the adjoining track at opposite ends of the machine. The elongate strip 26, which in one embodiment is made of flat bar measuring 1.25 inch×¼0 inch, extends horizontally and has a vertical side which is engaged by each wheel 16 as it passes through the machine. The strip is supported on the opposite side by means of track supporting brackets 27 bolted to the side of the machine by attachment plates 28. The brackets are spaced apart a distance ranging from 24" to 36". The preferred bracket 27 is made of 1 inch stainless steel tubes (horizontal portion) attached to the plate 28, which is rectangular and made of 12 gauge stainless steel. It will be understood that in the dishwashing unit, spray nozzles of standard construction (not shown) are strategically and appropriately placed to spray washing water and soap and rinsing water onto all of the dishes and utensils either arranged in the container 15 or in plastic racks placed in the container 15.

Figure 6:
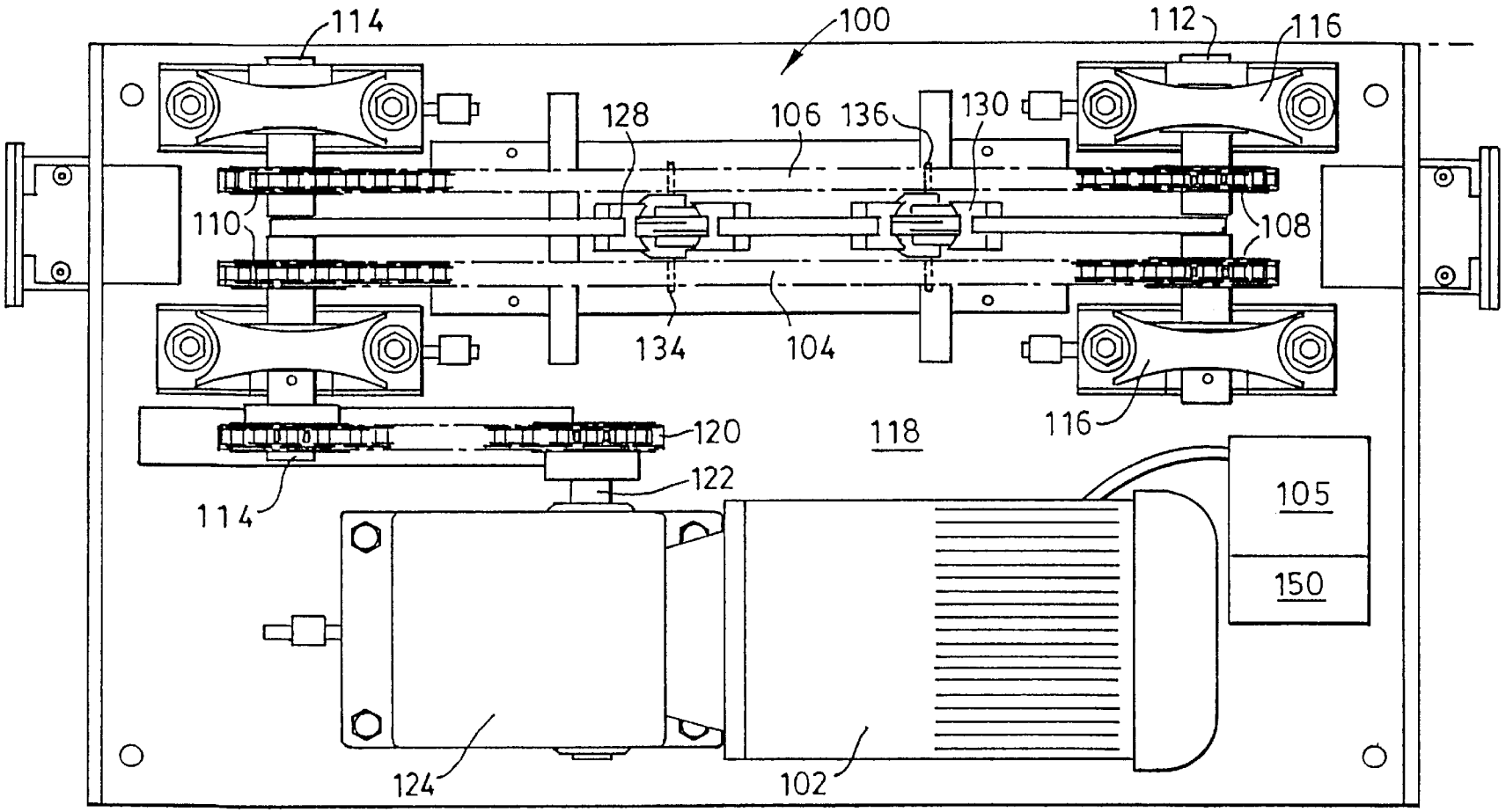
FIG. 6 is a plan view showing a preferred form of electrical drive mechanism including drive chains for moving the conveyor chain.
Figure 7:
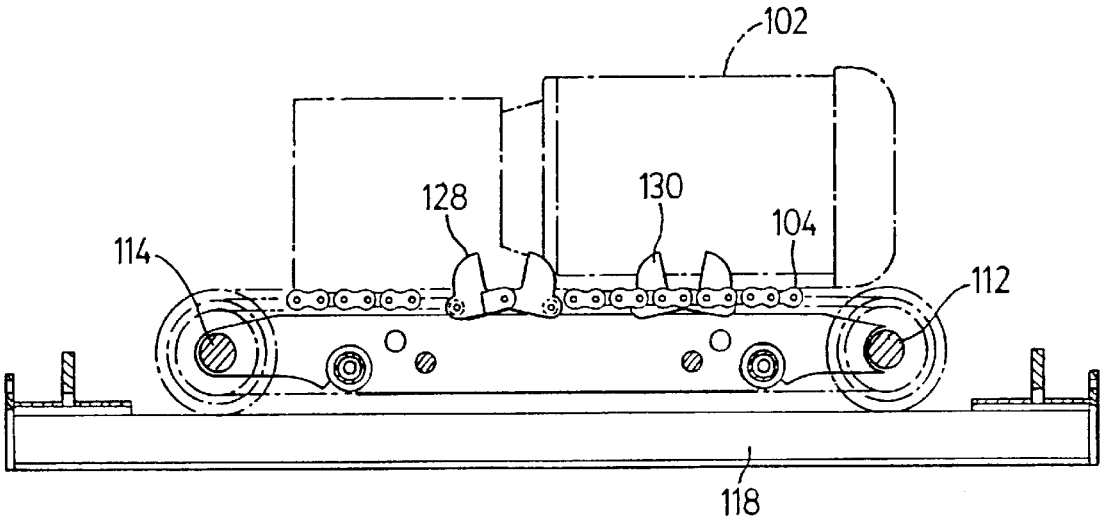
FIG. 7 is a sectional side view illustrating the drive chains used to drive the conveyor chain and the drive jaws mounted thereon.

Reference will now be made to FIGS. 6 and 7 which illustrate the preferred form of electrical drive mechanism for moving the conveyor chain along the monorail. This electrical drive mechanism is indicated generally at 100 and includes an electrical motor 102. The operation of the motor is controlled by means of a standard, known electrical controller illustrated schematically at 105 in FIG. 6. It will be understood that this controller combined with a suitable timer is able to stop and start the conveying device 52 on a preset, intermittent basis so that the containers will stop for a suitable interval to permit the transfer of dishes into or out of the containers at the loading and unloading stations. The controller and timer operate the chain drive for the conveyor chain in an indexed manner so that each container stops for a predetermined, suitable period of time at the dish loading and unloading stations and in the dishwasher unit itself. For some installations, a suitable period of time can be between 15 and 20 seconds.

As electrical drive mechanisms that can be used to operate the dishwashing system of the invention are known per se, a detailed description thereof herein is deemed unnecessary. A suitable drive mechanism is, for example available from Bridgeveyor Overhead Systems Limited of Markham, Ontario, and is sold as Model D500 Drive Unit. Briefly, this unit includes a pair of continuous parallel drive chains 104 and 106 which extend around two pairs of sprockets 108 and 110. These sprockets are rotatably mounted on horizontal shafts 112 and 114. These shafts are in turn mounted at each end by means of shaft support members 116 which can be bolted to a conveyor drive support platform 118. The shaft 114 is driven by means of continuous drive chain 120 which is turned by an output shaft 122 driven by the motor through a suitable gear box 124.

As shown in FIGS. 6 and 7, mounted between the drive chains are a number of pairs of drive chain dogs with only two pairs 128 and 130 illustrated. These pairs of dogs are arranged and sized to engage the conveyor chain 11 by holding and gripping adjacent guidance wheels 80 as illustrated in FIG. 5 as these wheels pass between the drive chains. The two dogs of each pair are pivotably connected together by means of pivot pins 134, 136 and these pivot pins are connected to the two drive chains 104, 106. The dogs operate to engage the perimeter of the guidance wheel so that the drive chains can move the conveyor chain along the monorail. The distance between each pair of the chain dogs 128, 130 is equal to the distance between two adjacent guide wheels 80. Each pair of chain dogs will engage a wheel 80 as it is rotated down to the lower travel path around the shaft 114.

The electrical control 105 can be a known controller capable of controlling movement of the conveyor chain by means of the DC electrical motor 102 and the drive system. One suitable controller is the KBPB (trademark) CYCLER sold by KB Electronics, Inc. This controller is solid state and capable of controlling the speed of the DC motor 102. It is able to provide instant anti-plug reversing and solid state dynamic braking and permits acceleration and deceleration to be adjusted.

The controller is operatively connected to a timing unit 150 which can be a separate known unit capable of providing the required time delays and the movement of the conveyor chain. One preferred form of timer is an asymmetrical multi-recycler such as type S1231 or S2231 sold under the trademark ELECTOMATIC. This unit has a variety of selectable time ranges, an automatic start and separate settings for the OFF time period and the ON time period. Its repeatability deviation is less than or equal to 1% and it comes in the form of a plug-in type module. In one preferred embodiment of the present dishwashing system, the timer causes the controller to stop the monorail conveyor for a set period of time between 15 and 20 seconds and then the conveyor moves for 10 to 15 seconds before stopping again.

In one preferred system, the automatic operation of the timer can be overridden by a push button switch that enables the worker or operator to stop the operation of the conveyor for as long as required, for example in an emergency situation or when a dish loading operation requires additional time. too.

It will be understood that the carriers or trays 15 are preferably designed to carry either custom built or standard plastic wash racks in which the dishes, utensils or pots are placed. In this way, the carrier itself can be a relatively open framework designed simply to hold the plastic rack which is placed in the holder through the open top. Each plastic rack can be detachably connected to the holder 15 by suitable screws or clips. One distinct advantage of the present dishwashing system is that it can eliminate the lifting and pushing of loaded and empty plastic racks as these racks can normally be left in the trays 15 even when the dishes are being loaded and unloaded. This can help to prevent lifting injuries to the workers responsible for the dishwashing operation. The workflow speed is also increased as no time is wasted in unloading clean racks from the conveyor system or loading empty racks onto the conveyor. The present dishwashing system also helps to eliminate rack storage areas and eliminates the washer belt of prior systems, thus allowing for unrestricted wash patterns and hence better cleaning action by the dishwasher. It will be understood that these advantages are gained at least in part because the holders (and any racks therein) can traverse the entire horizontal loop during use of this dishwashing system.

Additional important advantages of the present dishwashing system include its flexibility as the carriers or holders 15 and the racks fitted therein need not all be of the same construction. For example, some of the carriers or holders can be made to accept special items that otherwise can be hard to hold for dishwashing purposes. Also, the speed of the workflow with this system can be controlled through the adjustable indexing and dwell times and through a manual override switch available to individual workers (if desired). The present system can also eliminate transfer points between several conveyors that are commonly found in conventional systems. It also occupies a smaller footprint in the facility than a conventional system having a rack return conveyor and less horsepower is required. Furthermore, it is easier to maintain a system with a single drive unit (as described above) as opposed to multi-drive systems commonly found in known dishwashing systems. It is also possible to obtain better cleaning action for the same length of dishwashing unit because a longer wash time can be provided due to the length of time in which the trays dwell in the dishwasher.

It will be appreciated by those skilled in the art that various modifications and changes can be made to the described and illustrated conveyor system for dishwashing without departing from the spirit and scope of this invention. Accordingly, all such modifications and changes as fall within the scope of the appended claims are intended to be part of this invention.

What is claimed is:

1. A monorail system for carrying objects between loading and unloading stations, said system comprising:

a monorail forming a loop;

a continuous flexible conveying device movable along said monorail;

a holder for carrying objects;

a hanger bar mechanism for attaching said holder to said conveying device;

a guide wheel mounted to said holder in order to maintain said holder substantially horizontal between said loading and unloading stations; and a track along which said guide wheel runs between said loading and unloading stations, said track in use being mounted in a fixed position and being capable of providing a substantially horizontal force to said guide wheel between said loading and unloading stations in order to maintain said holder substantially horizontal, wherein at said loading and unloading stations, said holder is caused to tilt from the horizontal due to the position of said track relative to said monorail and engagement of said guide wheel with said track.

2. A monorail system according to claim 1 wherein said hanger bar mechanism includes a vertically extending hanger bar rigidly attached to said holder, and said hanger bar is pivotable about a horizontal axis located at its upper end and parallel to the adjacent monorail.

3. A monorail system according to claim 2 further comprising one or more tables extending lengthwise below said monorail and conveying devices and a support frame to support said monorail, wherein said holder extends perpendicularly and normally horizontally from said hanger bar.

4. A monorail system according to claim 2 further comprising one or more workstations extending lengthwise below said monorail and conveying devices and a support frame to support said monorail, wherein said holder extends perpendicularly and normally horizontally from said hanger bar.

5. A monorail system according to claim 1 further comprising electrical drive means to move said conveying device along said monorail; and electrical control means to control said drive means and to stop and start said conveying device at said loading and unloading stations.

6. A dishwashing system comprising:

a monorail forming a loop;

a continuous, flexible conveying device moveable along said monorail;

a holder for carrying objects;

a hanger bar mechanism for attaching said holder to said conveying device;

a wheel mounted to said holder in order to maintain said holder substantially horizontal between loading and unloading stations;

a dishwasher unit through which said holder is movable by said conveying device; and a track along which said guide wheel runs between said loading and unloading stations, said track in use being mounted in a fixed position and being capable of providing substantially horizontal force to said guide wheel between said loading and unloading stations in order to maintain said holder substantially horizontal, wherein at said loading and unloading stations, said holder is caused to tilt from the horizontal due to the position of said track relative to said monorail and engagement of said wheel with said guide track.

7. A dishwashing system according to claim 6 further wherein said hanger bar mechanism includes a vertically extending hanger bar rigidly attached to said holder, said hanger bar being pivotably mounted at its upper end in order to allow pivoting about a horizontal axis that is parallel to an adjacent section of the monorail.

8. A dishwashing system according to claim 7 including a dryer, said holder being movable horizontally through the length of said dryer by said conveying device, wherein there are a number of holders for carrying objects attached to said conveying device, each holder passes through said dishwasher unit and dryer during operation of said dishwashing system, and the or each holder extends perpendicularly and normally horizontally from its hanger bar.

9. A dishwashing system according to claim 8 further comprising an electrical motor to move said conveying device along said monorail; and electrical controller to control said motor and to stop and start said conveying device at said loading and unloading stations.

10. A dishwashing system according to claim 6 wherein said hanger bar mechanism includes at least two vertically extending hanger bars rigidly attached to said holder, each hanger bar being pivotably mounted at its upper end in order to allow tilting of the holder about a horizontal axis that is parallel to an adjacent section of the monorail.

11. A conveying system for carrying objects to and from loading and unloading stations comprising:

a monorail forming a loop;

a continuous, flexible conveying device movable along said monorail;

holders for carrying objects;

means for attaching said holders to said monorail;

support frame members for rigidly supporting said monorail;

a wheel mounted to each holder to maintain the holder substantially horizontal between loading and unloading stations; and track means along which the wheels run between said loading and unloading stations, said track means being rigidly mounted to a support structure and capable of providing substantially horizontal force to said guide wheels between said loading and unloading stations in order to maintain said holders substantially horizontal, wherein at said loading and unloading stations, said holders are caused to tilt from the horizontal due to the position of said track means relative to said monorail and engagement of said guide wheels with said track means.

12. A conveying system according to claim 11 wherein said attaching means includes at least two vertically extending hanger bars rigidly attached to each holder, each hanger bar being pivotally attached to said conveying device adjacent an upper end of the bar.

13. A conveying system according to claim 12 wherein each holder extends perpendicularly and normally horizontally from each of its respective hanger bars.

14. A conveying system according to claim 11 further including a dishwashing unit through which said holders are moved horizontally by said conveying device, wherein said conveying device is a continuous chain arranged within the monorail.

15. A conveying system according to claim 14 further comprising an electrical motor to move said conveying device along said monorail; and an electrical controller to control said motor and to permit said conveying device and attached holders to be advanced in intermittent fashion.

16. A dishwashing system comprising:

a dishwasher unit with a passageway extending therethrough;

a monorail-type conveyor forming a substantially horizontal loop; and a number of holders mounted along said conveyor for holding dishes and other utensils to be cleaned by said dishwasher unit, wherein, during use of said system, said holders can traverse the entire loop and are movable through said passageway by said conveyor in order to clean said dishes and other utensils.

17. A dishwashing system comprising:

a dishwasher unit with a passageway extending therethrough;

a monorail-type conveyor;

a number of holders mounted along said conveyor for holding dishes and other utensils to be cleaned by said dishwasher unit;

at least one wheel rotatably mounted to each holder; and track means for tilting each of said holders at a workstation for loading or unloading dishes and other utensils, each wheel running along said track means during operation of said system, wherein said holders are movable through said passageway by said conveyor in order to clean said dishes and other utensils.

18. A dishwashing system according to claim 16 wherein said conveyor includes a rigidly mounted monorail that extends through said dishwasher unit and a continuous conveyor chain movably mounted in said monorail.

19. A dishwashing system according to claim 18 wherein said conveyor includes an electrical drive for moving said conveyor chain along said monorail and an electrical controller for operating said drive in an indexed manner so that each container stops for a predetermined period of time at dish loading and unloading stations and in said dishwasher unit.

20. A conveying system for transporting objects between workstations comprising:

a monorail adapted to be rigidly mounted so as to extend in a loop through said workstations;

an elongate, continuous, flexible conveying device movable along said monorail;

a number of spaced-apart object holders suspended from said monorail;

hanger bar mechanisms for connecting said holders to said conveying device for movement therewith, said object holders being open-topped in an upright position;

at least one stabilizing wheel rotatably mounted to each object holder; and an elongate track adapted to be fixedly mounted below at least a substantial portion of the length of said monorail and along which the stabilizing wheels can roll, wherein engagement between the wheels and track normally maintains said object holders in a substantially upright position during movement thereof between said workstations and permits said object holders to tilt substantially at one or more of said workstations about a generally horizontal tilt axis extending substantially parallel to an adjacent section of the monorail.

21. A conveying system according to claim 20 wherein each hanger bar mechanism includes one or more vertically extending hanger bars rigidly attached to a respective object holder.

22. A conveying system according to claim 21 further comprising an electric motor to move said conveying device along said monorail; and an electrical controller to control said motor and to stop and start said conveying device at said workstations, said electrical controller including an adjustable timer unit.

* * * * *